US006796910B1

(12) United States Patent
Foster

(10) Patent No.: US 6,796,910 B1
(45) Date of Patent: Sep. 28, 2004

(54) LASER GUIDED PUTTING AID AND ALIGNMENT DEVICE

(76) Inventor: Clark B. Foster, 23631 Wakefield Ct., Laguna Niguel, CA (US) 92677

( * ) Notice: Subject to any disclaimer, the term of this patent is extended or adjusted under 35 U.S.C. 154(b) by 0 days.

(21) Appl. No.: 10/439,391

(22) Filed: May 16, 2003

(51) Int. Cl.[7] ..... A63B 69/36
(52) U.S. Cl. ..... 473/220
(58) Field of Search ..... 473/219, 220, 473/223, 226, 231, 237, 238, 240, 266, 267, 268, 269; 362/259, 191, 427; 248/300

(56) References Cited

U.S. PATENT DOCUMENTS 3,188,602 A * 6/1965 Toedtman et al. ..... 439/479
3,988,051 A * 10/1976 Robinson ..... 439/772
5,207,429 A * 5/1993 Walmsley et al. ..... 473/220
5,351,585 A * 10/1994 Leseberg et al. ..... 81/426
5,388,831 A * 2/1995 Quadri et al. ..... 473/220
5,472,204 A * 12/1995 English et al. ..... 473/220
5,494,290 A * 2/1996 Stefanoski ..... 473/220
5,964,668 A * 10/1999 Tai et al. ..... 473/220
6,004,230 A * 12/1999 Hooker ..... 473/409
6,450,893 B1 * 9/2002 Primiano et al. ..... 473/220
6,482,099 B1 * 11/2002 Schaum ..... 473/220
6,605,005 B1 * 8/2003 Lin ..... 473/220

* cited by examiner

*Primary Examiner*—Stephen P. Garbe
*Assistant Examiner*—Nini F. Legesse
(74) *Attorney, Agent, or Firm*—Morland C. Fischer

(57) ABSTRACT

A laser guided putting aid to enable a golfer to practice and perfect his putting stroke. The laser guided putting aid includes a combination laser and clamp by which the laser is detachably connected to the shaft of the putter without having to make any changes thereto. The laster emits a pattern of light that fans out in a vertical plane so as to cast a vertical reference line against a target that is located at the end of a putting surface. The golfer practices his putting stroke while attempting to maintain the position of the vertical reference line against the target. If the golfer's putting strokes becomes non-linear, the reference line will move off the target to immediately provide the golfer with a visual indication that his stroke is off-line. An alignment device is included so that the laser is connected to the shaft of the putter such that the vertical plane in which the pattern of light is emitted from the laser will lie in perpendicular alignment with each of the putting surface and the striking face of the putting head of the golfer's putter.

20 Claims, 8 Drawing Sheets

LASER GUIDED PUTTING AID AND ALIGNMENT DEVICE

BACKGROUND OF THE INVENTION

1. Field of the Invention

This invention relates to a laser guided putting aid that is detachably connected to an existing putter by which to enable a golfer to practice and perfect his putting stroke. An alignment device is included which allows that golfer to accurately align the laser guided putting aid to the putting face of his putter during the detachable connection of the putting aid thereto.

2. Background Art

Small lasers have been used with golf clubs to enable golfers to practice their stroke and improve their game. However, in some cases, the lasers cannot be coupled to an existing golf club, such that the golfer cannot use his own club while practicing his stroke. That is to say, either a specially design club must be used to accommodate the laser or modifications must be made to the existing club before the laser can be coupled thereto. In other cases, the same laser is not interchangeable between the clubs of right and left handed golfers. Thus, not all laser practice aids are suitable for use by all golfers and/or by all golf clubs. In yet other cases, the lasers cannot be accurately aligned and maintained in constant alignment with the golfer's club, such that the laser practice aid provides unreliable results which can hurt the golfer's game more than improve it.

Accordingly, it would be desirable to have a laser guided putting :aid that can be quickly connected to and removed from the golfer's own putter without requiring that changes first be made to the putter, can be accurately aligned with the putting head to provide reliable results, and can be easily coupled to any putter, regardless of whether the golfer is right or left handed.

Examples of known laser practice aids for use by golfers to improve their game is available by referring to one or more of the following United States Patents:

| | | |
|---|---|---|
| 5,207,429 | Walmsley et al | May 4, 1993 |
| 5,388,831 | Quadri et al | Feb. 14, 1995 |
| 5,964,668 | Tai et al | Oct. 12, 1999 |
| 5,193,812 | Hendricksen | Mar. 16, 1993 |
| 5,472,204 | English et al | Dec. 5, 1995 |
| 5,709,609 | Carney | Jan. 20, 1998 |
| 6,004,230 | Hooker | Dec. 21, 1999 |

SUMMARY OF THE INVENTION

In general terms, a laser guided putting aid is disclosed to be detachably connected to an existing putter by which to enable a golfer to practice and perfect his putting stroke. In a preferred embodiment, the laser guided putting aid is used in combination with a flat putting surface having a friction resistant pad over which is laid a cover to simulate a putting green. A target (e.g. a cup) is located at one end of the putting surface, and the golfer's ball is placed at the opposite end. A target post extends upwardly from the target cup. The laser guided putting aid is coupled to the shaft of the putter by means of a clamp so as to emit a light pattern that fans out in a vertical plane towards the target cup, such that a vertical ray of light is projected along the putting surface from the laser to the target cup, and a vertical ray of light is projected along the target post extending upwardly from the target cup.

If the golfer's putting stroke is off target (i.e. non-linear), the horizontal ray of light will shift off the target post to provide an instantaneous visual indication to the golfer that his putting stroke is off-line. The golfer can continue to practice his putting stroke until the horizontal ray of light no longer moves off the target post.

The laser includes an upper body and a lower turret that is rotatable relative to the upper body. The upper laser body includes a battery voltage supply and an on-off switch. The rotatable turret includes means to direct a beam of laser light to a cylindrical lens located within a rotatable lens housing. The cylindrical lens generates the light pattern that is emitted from the lens housing so as to fan out in the vertical plane along the putting surface towards the target cup. The turret is rotatable in order for the laser to be used with the putters of both left and right handed golfers. The lens housing is rotatable to allow the laser to be initialized in order to account for the particular stance of the golfer and the manner in which the golfer holds his putter relative to the golf ball.

The clamp for detachably connecting the laser to the golfer's putter includes a pair of opposing clamping jaws that are sized and shaped to surround and grip the shaft. One of the clamping jaws is pivotally connected and rotatable relatively to the other clamping jaw under the control of a toggle lever. The toggle lever has a cam surface that is rotatable into contact with the pivoting clamping jaw so as to apply a clamping force thereagainst, whereby to cause the pivoting clamping jaw to rotate towards and close against the other clamping jaw such that the clamp and the laser carried thereby are now reliably attached to the shaft of the putter without requiring any changes to the putter.

According to a first embodiment, the alignment device is a tool that is temporarily coupled to the laser to align the laser with the head of the golfer's putter so that the light pattern being emitted from the lens housing will fan out in a vertical plane that is perpendicular to the putting surface. The alignment tool includes a pair of spaced, parallel aligned connecting arms that are bent at a 90 degree angle, a laser contact rod ex tending between the connecting arms at one end of the alignment tool, and a striking face contact rod extending between the connecting arms at the opposite end of the alignment tool. The laser contact rod is pivotally connected to the laser at an alignment slot formed in the rotatable turret at the bottom of the laser. The laser contact rod of the alignment tool is then rotated within the alignment slot at the same time that the clamp is rotated around the shaft of the putter until the striking face contact rod of the alignment tool is moved flush against the striking face of the putting head of the putter. A rotation of the clamp causes a corresponding rotation of the laser connected thereto such that the laser will now be positioned relative to the striking face of the putting head so that the pattern of light emitted from the lens housing thereof will fan out in the vertical plane along the putting surface to cause the horizontal ray of light to be projected against the target post extending upwardly from the target cup.

In an alternate embodiment, the aforementioned alignment device is a reflecting surface (e,g., a mirror) that is mounted on a raised side wall of the putting surface. The head of the putter is located against the opposite sidewall of the putting surface. The laser carried by the putter shaft generates a beam of light laterally across the putting surface that is reflected by the opposing reflecting surface back to the laser. The clamp is rotated around the shaft to cause a corresponding rotation of the laser connected thereto until the incident and reflected beams of light which are generated by the laser and reflected by the reflecting surface across the putting surface and between the sides thereof are coincident. The laser will now be aligned relative to the striking face of the putter so as to emit the pattern of light at one end of the putting surface that will fan out in the vertical plane along the putting surface to cause the horizontal ray of light to be projected against the target post extending upwardly from the target cup at the opposite end of the putting surface.

DETAILED DESCRIPTION

Figure 1:
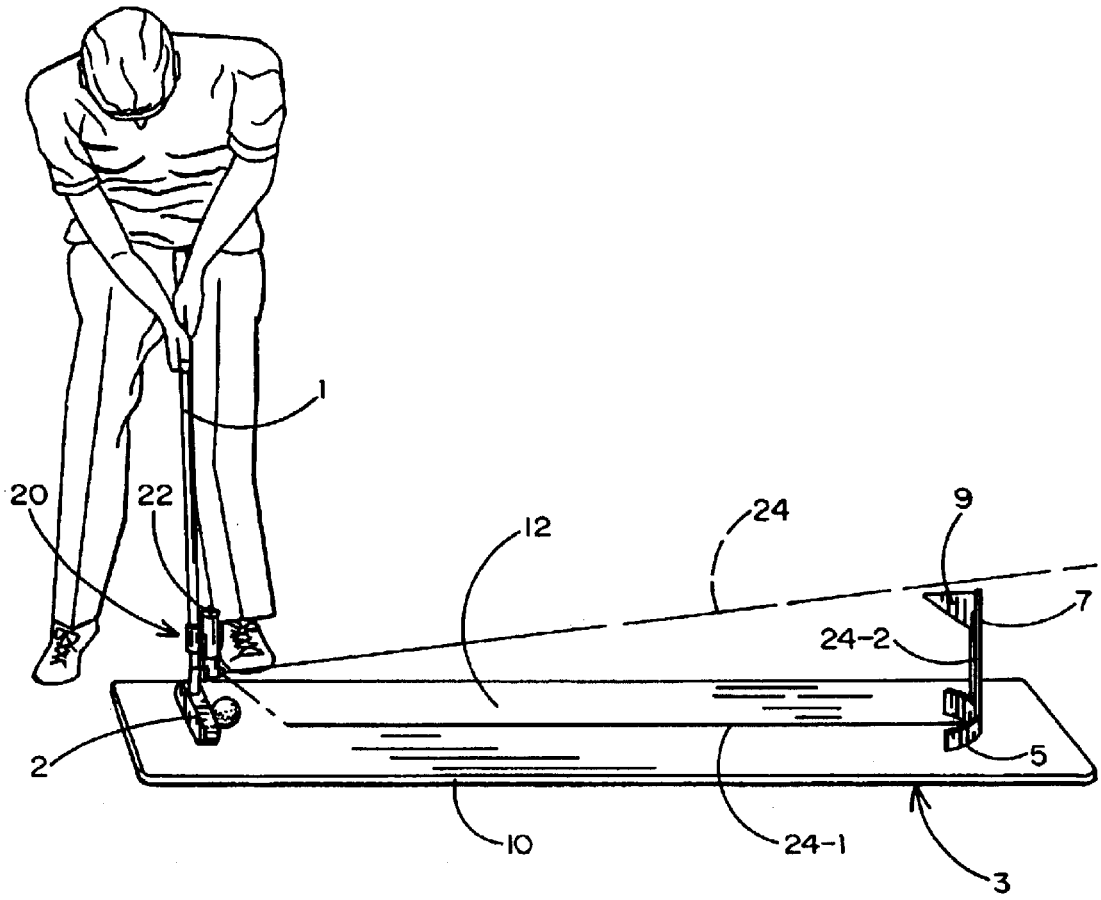
FIG. 1 shows a golfer holding his putter with the laser guided putting aid coupled to the shaft thereof for practicing his putting stroke on a putting surface according to a first embodiment of this invention.

The laser guided putting aid 20 by which to enable a golfer to practice and perfect his putting stroke is initially described while referring to FIG. 1 of the drawing: where there is shown a golfer approaching a golf ball with his putter 1 in hand. The golf ball is shown adjacent the putting head 2 at one end of an artificial putting surface 3 having a target (e.g. a cup) 5 located at the opposite end. A target post 7 projects upwardly from the target 5, and a decorative flag 9 is affixed to the top of post 7. The target post 7 must be wide enough to enable a ray of light 24-2 to be projected thereagainst to establish a vertical reference line for a purpose that will soon be explained.

The putting surface 3 preferably includes a foam rubber pad 10 along the bottom which provides a friction surface to resist slippage if the putting surface 3 is laid on a floor. A colored cotton/nylon carpet 12 is attached over the pad 10 to simulate a putting green along which the golf ball can be rolled towards the target 5. However, it is to be understood that while the artificial putting surface 3 herein described may introduce a more realistic environment for the golfer to practice his putting stroke, the aforementioned details of the putting surface 3 are not to be considered a limitation of this invention. In fact, the laser guided putting aid 20 of this invention may be used with a different putting surface (such as that shown in FIG. 7) or with the putting surface eliminated altogether. In this regard, the golf ball can be stroked along any smooth, flat surface towards any designated target behind which is located a wall, door or other upright plane against which the aforementioned vertical reference line can be projected.

As will be described in greater detail when referring to FIGS. 5A and 5B of the drawings, the laser guided putting aid 20 is attached to and carried by the shaft of the putter 1 by means of an adjustable clamp 44. As will also be disclosed in greater detail hereinafter, the laser guided putting aid 20 includes a laser 22 that is adapted to generate a light pattern 24 that fans out in a vertical plane along putting surface 3. In the example of FIG. 1, the light pattern 24 generated by laser 20 will cause a ray of light 24-1 to be projected horizontally and continuously along the artificial putting surface 3 between the putting head 2 of putter 1 and the target 5 and the previously mentioned ray of light 24-2 to be projected vertically and continuously along the target post 7 between the target 5 and the ornamental flag 9.

Figure 2:
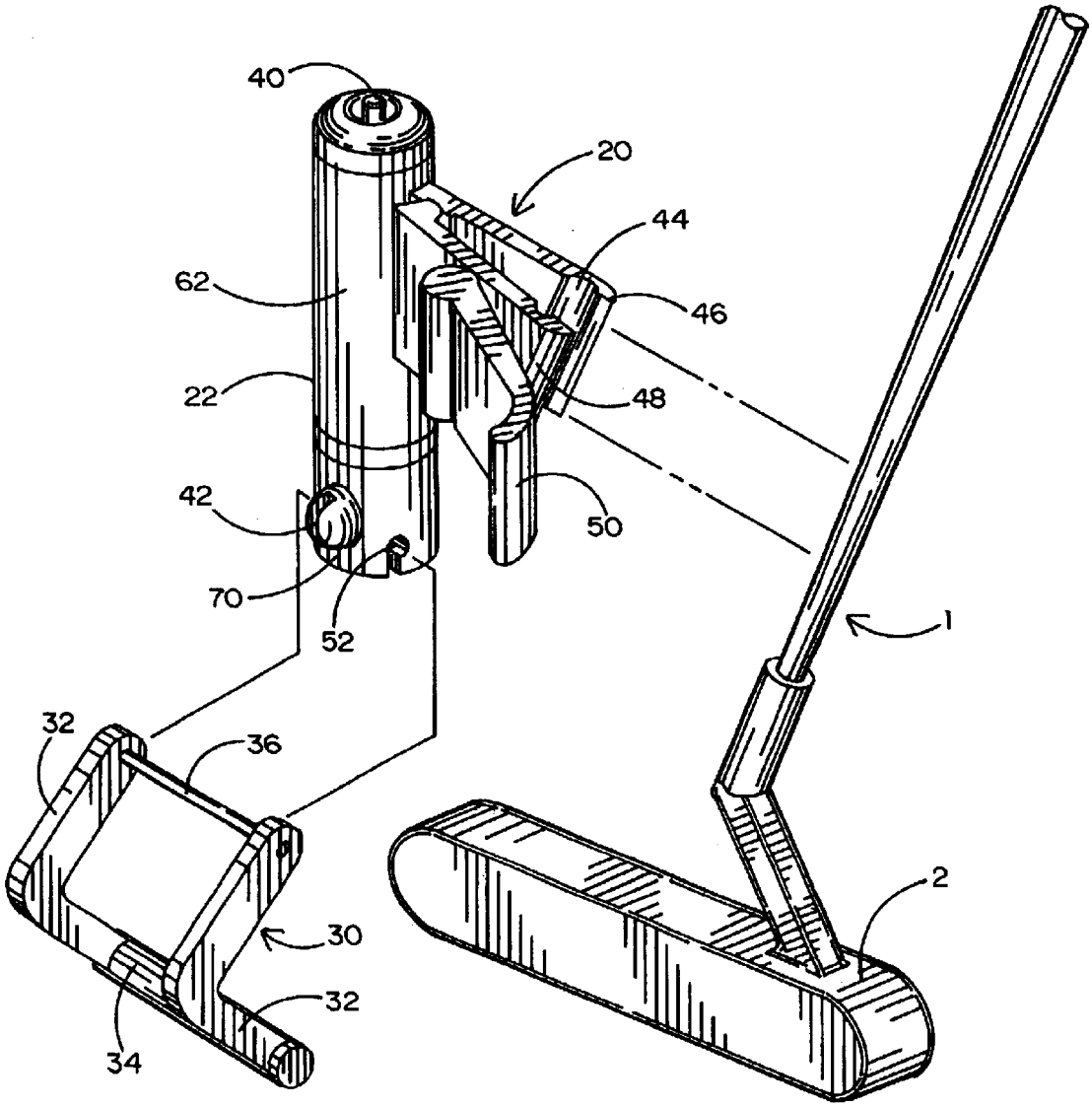
FIG. 2 is an exploded view of the laser guided putting aid, an alignment tool, and the shaft of the putter shown in FIG. 1.
Figure 3:
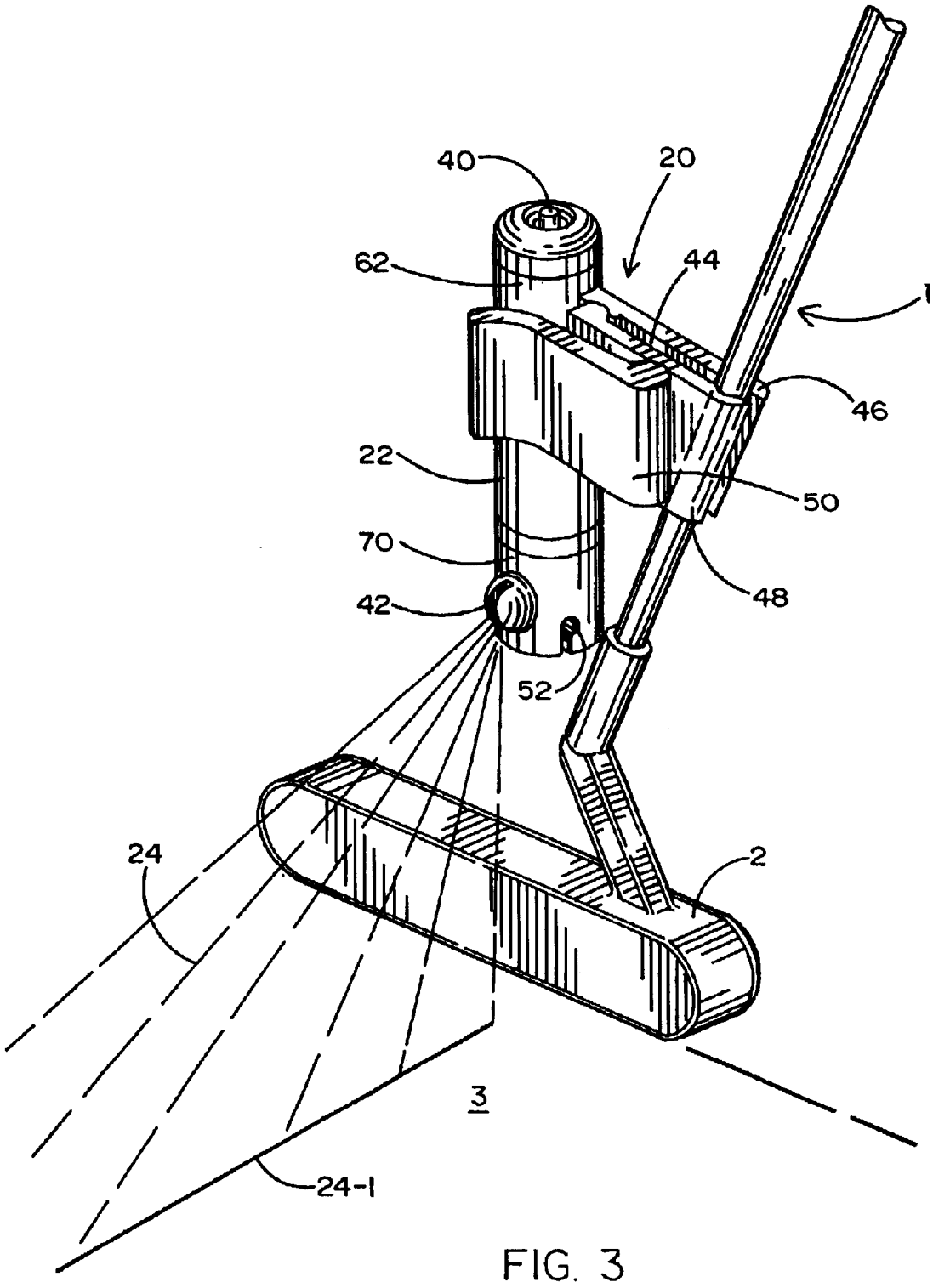
FIG. 3 shows the laser guided putting aid of FIG. 2 detachably connected to the shaft of the putter.

Referring concurrently to FIGS. 2 and 3 of the drawings, FIG. 2 shows an exploded view of the putter 1, the laser guided putting aid 20, and an alignment tool 30, while FIG. 3 shows the laser guided putting aid 20 detachably connected to the shaft of putter 1 and aligned with the putting head 2 by means of alignment tool 30 to generate the light pattern 24 that, as was previously described while referring to FIG. 1, fans out in a vertical plane across the artificial putting surface 3 to project horizontal and vertical rays of light (designated 24-1 and 24-2) along the putting surface 3 and the target post 7 to enable the golfer to practice and perfect his putting stroke in a manner to be described below.

As will also soon be described, the laser guided putting aid 20 includes a laser 22 having an on/off switch 40 located at the top thereof and a rotatable turret 70 located at the bottom. A rotatable lens housing 42 is carried by the turret 70 of the laser 22 from which the light pattern (designated 24 in FIG. 3) is emitted. A coextensive clamp 44 which extends outwardly from the upper body 62 of laser 20 has a pair of clamping jaws 46 and 48 that are spaced from one another and shaped to surround and grasp the shaft of putter 1. The clamp 44 also includes a pivotal toggle lever 50 by which to control the movement of one clamping jaw 46 toward the other jaw 48 and the detachable connection of the clamp 44 to the shaft of putter 1. An alignment slot 52 (best shown in FIG. 2) is located in the rotatable turret 70 at the bottom of laser 22 within which to receive and capture the alignment tool 30 so that the laser 22 of the putting aid 20 can be accurately aligned with the putting face of the putting head 2 of putter 1, whereby the light pattern 24 generated by laser 22 will fan out in the vertical plane along the putting surface 3 as shown in FIG. 3.

The alignment tool 30 shown in FIG. 2 includes a pair of connecting arms 32. Each connecting arm 32 is bent at 90 degrees so that the alignment tool 30 will conform to (i.e., clear) the putting head 2. The connecting arms 32 of alignment tool 30 are held in spaced parallel alignment with one another. A striking face contact rod 34 extends between first ends of the pair of connecting arms 32 to be rotated into contact with the striking face of putting head 2. A laser contact rod 36 extends between the opposite ends of the pair of connecting arms 32 to be pivotally received and rotated within the alignment slot 52 at the bottom of the laser 22 of laser guided putting aid 20. As will be explained when referring to FIG. 6 of the drawings, the alignment tool 30 is positioned between the laser 22 and the putting head 2 so as to enable the laser 22 to be clamped to the shaft of putter 1 in the assembled relationship of FIG. 3 with the optical axis of the lens housing 42 of laser 22 oriented so that the light pattern 24 emitted by laser 22 will fan out along a vertical plane that lies in perpendicular alignment with each of the putting surface 3 and the striking face of the head 2 of the golfer's putter 1.

Figure 4:
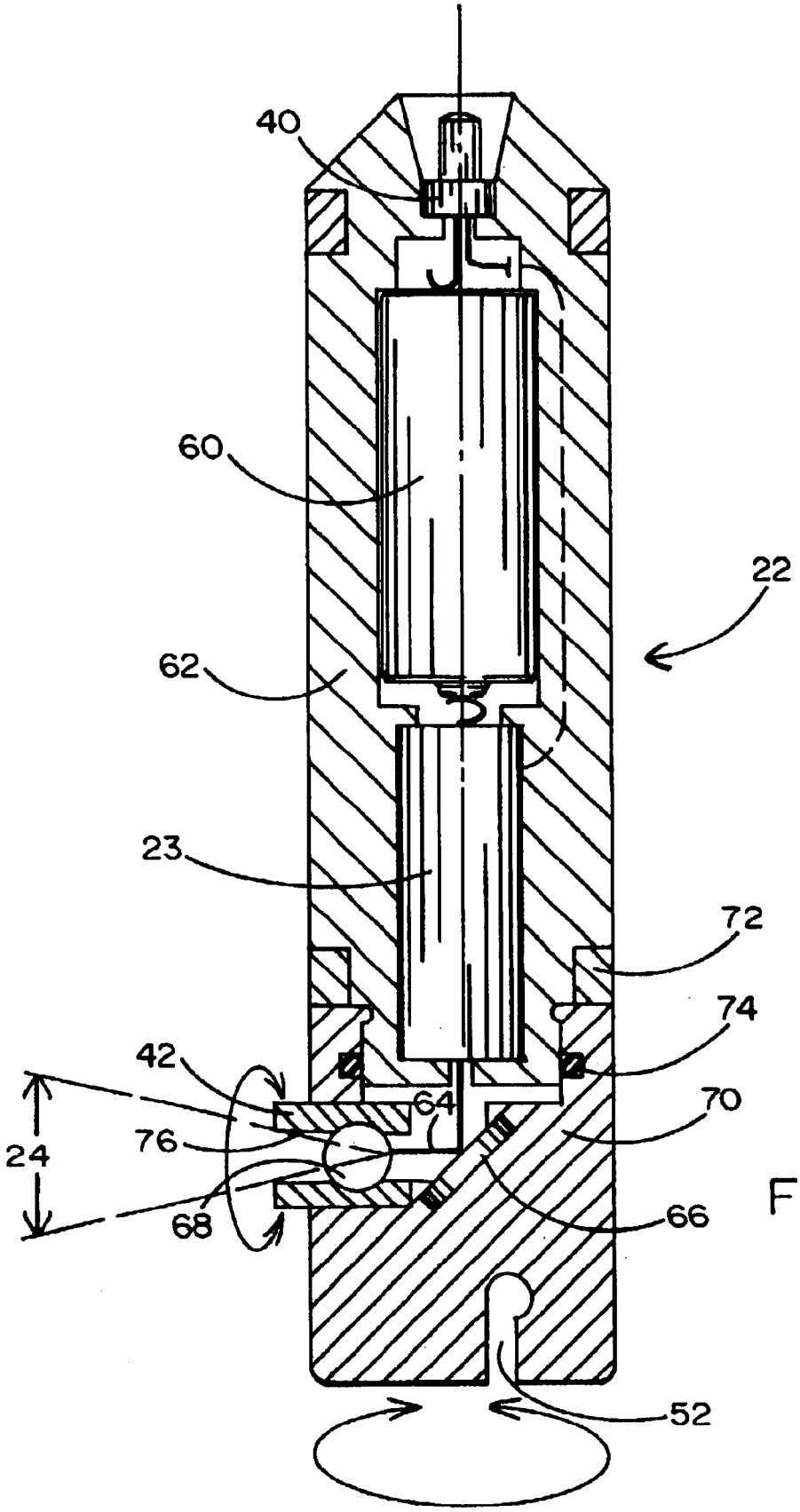
FIG. 4 is a cross-section of the laser from the laser guided putting aid.

A description of the laser 22 of the laser guided putting aid 20 is now provided while referring to FIG. 4 of the drawings. The laser 22 used herein is preferably a 650 nanometer, 5 milliwatt device, such as that commercially available from Toshiba Corporation. However, certain modifications are made to laser 22 so that it will be customized for this application of enabling golfers to practice and perfect their putting stroke. The commercially available laser 22 includes a set of (e.g. three) batteries 60 that are connected in series within the upper laser body 62 to power a laser emitter 23. The operation of the on-off switch 40 atop the upper body 62 causes a laser beam 64 to be generated by emitter 23 and directed towards a fixed mirror 66. The mirror 66 reflects the laser beam 64 towards a cylindrical glass lens 68 that is mounted within the rotatable lens housing 42 of the rotatable turret 70 at the bottom of laser 22. Alternatively, the mirror 66 may be eliminated and the laser emitter 23 oriented so that the laser beam 64 is aimed directly at the lens 68. The laser beam 64 is refracted by cylindrical lens 68 to create the light pattern 24 that fans out in the vertical plane along the putting surface 3 shown in FIG. 1.

In order to customize the laser 22 for application as a putting aid, the rotatable turret 70 is provided opposite the upper laser body 62 so as to be capable of rotating at least 180 degrees around the longitudinal axis of laser 22 relative to upper laser body 62 when the putting aid 20 is to be used in combination with the putter of a left handed golfer. A pair of elastomeric rings 72 and 74 are located at the interface of the upper laser body 62 and the turret 70 to eliminate rattling and facilitate the rotation of turret 70 relative to upper body 62.

Moreover, the rotatable lens housing 42 that is carried by the rotatable turret 70 and within which the cylindrical lens 68 is housed is provided with a keyway or a slot 76 that is sized to receive therewithin a coin or a suitable tool (not shown) to which a rotational force may be applied to cause a rotation of lens housing 42 and a corresponding rotation of the cylindrical lens 68. By virtue of the keyway 76 in the rotatable lens housing 42, the laser guided putting aid 20 of FIG. 1 can be initialized according to the habits of the golfer. That is to say, and as was pointed out above, it is desirable for the vertical plane of the light pattern 24 generated by lens 68 and emitted from the lens housing 42 of laser 22 to be in perpendicular alignment with the horizontal plane of the putting surface 3. Accordingly, in order to compensate for the golfer's unique stance and the manner in which he angles his putter while approaching a golf ball, the lens housing 42 can be selectively rotated relative to turret 70 until the plane of the light pattern 24 is moved into perpendicular alignment with the putting surface 3 prior to the practice exercise.

Figure 5A:
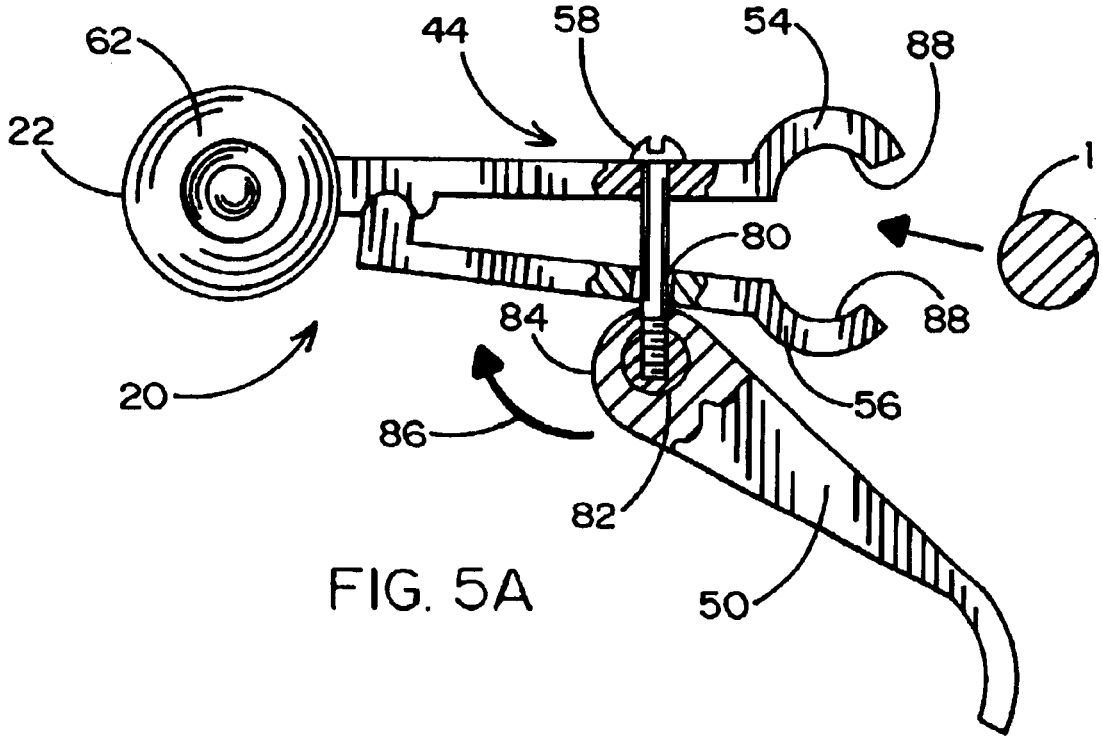
FIG. 5A shows a clamp in an open position at which the laser guided putting aid can be moved into engagement with the shaft of the golfer's putter.
Figure 5B:
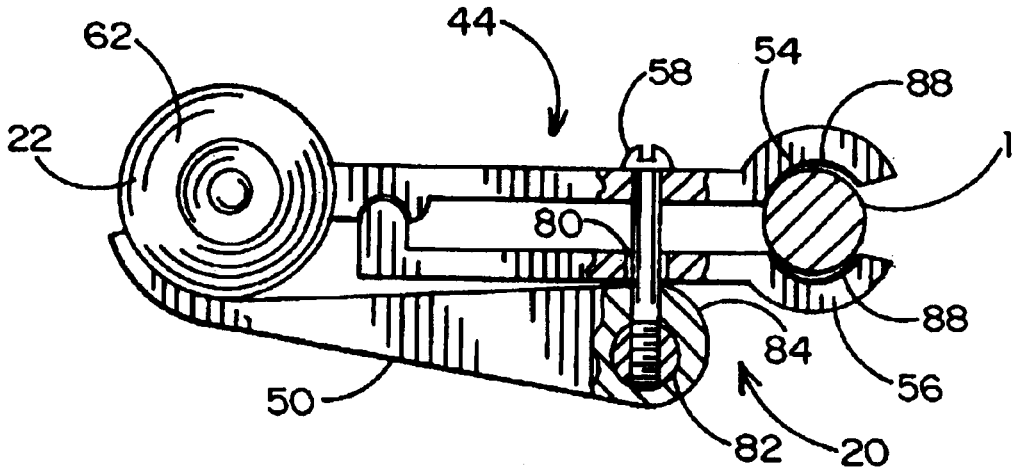
FIG. 5B shows the clamp of FIG. 5A in the closed position at which the laser guided putting aid is detachably connected to the shaft.

Details are provided of the adjustable clamp 44 by which the laser guided putting aid 20 is detachably connected to the shaft of the putter 1 while referring to FIGS. 5A and 5B of the drawings. As previously described, the clamp 44 includes a pair of clamping jaws 54 and 56. One jaw 54 of clamp 44 is fixedly connected to the upper laser body 62. The other jaw 56 of clamp 44 is pivotally connected to the fixed jaw 54. The pivoting jaw 56 of clamp 44 is rotatable towards and away from the fixed jaw 54 depending upon the action of the toggle lever 50.

The toggle lever 50 is pivotally connected to clamp 44 by means of a pair of threaded fasteners (e.g., bolts) 58, only one of which being visible. The fasteners 58 extend from the fixed clamping jaw 54, through openings 80 in the pivoting clamping jaw 56, for receipt at a toggle axle 82 around which the toggle lever 50 is adapted to rotate. The toggle lever 50 has a cam surface 84 that is rotated into contact with the pivoting clamping jaw 56 to apply a clamping pressure thereagainst. In this regard, FIG. 5A shows the toggle lever 50 located at a first position where the cam surface 84 thereof is rotated out of contact with the pivoting clamping jaw 56. In the first position of toggle lever 50 shown in FIG. 5A, no clamping pressure is applied against the pivoting clamping jaw 56, and the opposing jaws 54 and 56 are separated from one another. Accordingly, the clamp 44 of the laser guided putting aid 20 can now be coupled to or removal from the shaft of putter 1.

FIG. 5B shows the clamp 44 after the toggle lever 50 has been rotated around its toggle axle 82 and towards the laser 22 in the direction indicated by the reference arrow 86 of FIG. 5A. In this case, the cam surface 84 of toggle lever 50 is rotated into contact with the pivoting clamping jaw 56 of clamp 44 so as to apply a clamping pressure thereagainst. The pivoting clamping jaw 56 is caused to rotate towards the fixed clamping jaw 54, whereby the opposing jaws 54 and 56 are now closed together in surrounding engagement with the shaft of putter 1. Accordingly, the clamping pressure generated by the cam surface 84 of rotating into contact with the pivoting clamping jaw 56 toggle lever 50 causing a corresponding clamping force between the jaws 54 and 56 by which the clamp 44 and the laser 22 of putting aid 20 are detachably connected to and carried by the shaft of putter 1.

To enhance the clamping engagement of the clamp 44 to the shaft of putter 1, rubber friction strips 88 may be disposed along the opposing clamping jaws 54 and 56. The putting aid 20 remains clamped to putter 1 until the toggle lever 50 is rotated in a direction opposite to that represented by the reference arrow 86 of FIG. 5A so as to permit the pivoting clamping jaw 56 to rotate away from the fixed clamping jaw 54 and thereby relieve the clamping force being applied against the shaft of putter 1. It may be appreciated at this time that the laser guided putting aid 20 is clamped to and removed from the putter 1 without requiring any changes to the putter. Therefore, the putting aid 20 of this invention can be used with any conventional putter, regardless of whether the golfer is right or left handed and without having to alter the original configuration of the putter.

Figure 6A:
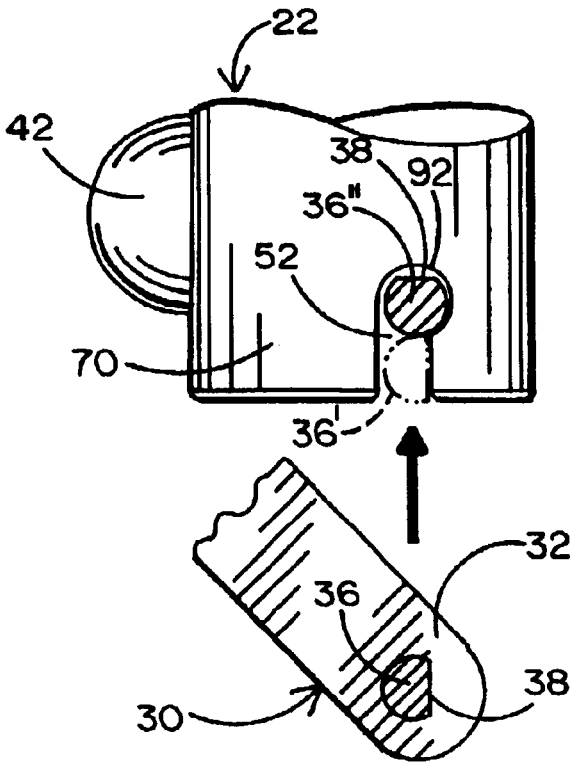
FIGS. 6A–6D illustrate the steps by which the alignment tool of FIG. 2 is used for aligning the laser guided putting aid to the putting head of the golfer's putter.
Figure 6B:
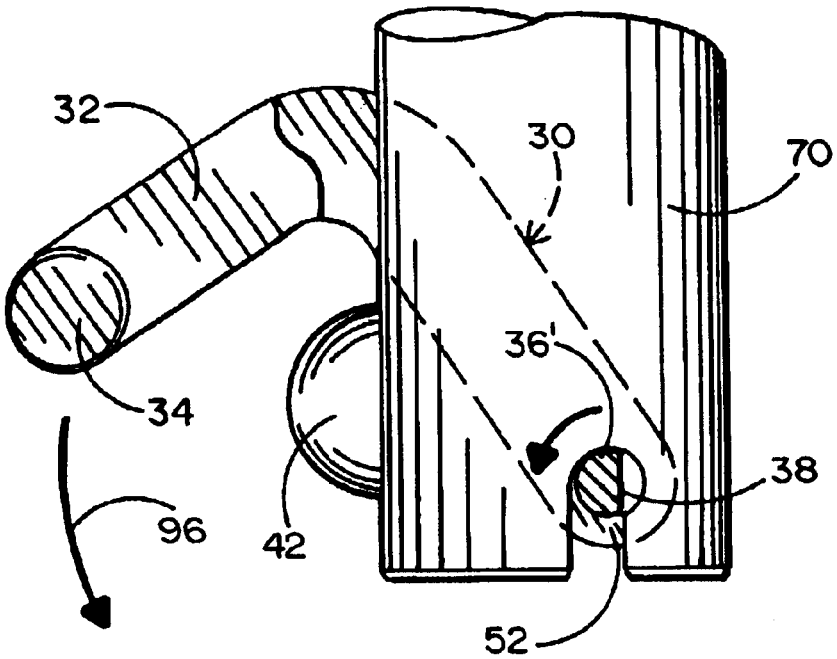

Use of the alignment tool 30 (of FIG. 2) to properly align the laser 22 of putting aid 20 with the striking face of the putting head 2 of the golfer's putter 1 is now described while referring to FIGS. 6A–6D of the drawings. As earlier described, and as is best shown in FIG. 6A, an alignment slot 52 is formed at the bottom of laser 22 within the rotatable turret 70. The alignment slot 52 runs completely across the bottom of the turret 70 and is sized to receive therewithin the laser contact rod 36 that extends between the connecting arms 32 at one end of alignment tool 30.

However, to ensure that the alignment tool 30 is reliably coupled to the laser 22 during the alignment process, the laser contact rod 36 is provided with a flat face 38. The golfer grasps the alignment tool 30 (at the pair of connecting arms 32 thereof) and inserts the laser control rod 36 into alignment slot 52. An upward pushing force is then applied by the golfer to alignment tool 30. The width of the alignment slot 52 is selected so that the laser contact rod 36 will slide upwardly therethrough only when the alignment tool 30 is oriented so that the flat face 38 of the laser contact rod (shown in phantom lines in FIG. 6A and represented by the reference numeral 36') rides along a side wall of slot 52.

The alignment slot 52 ends at a relatively wide terminus 92. As the golfer pushes upwardly on the alignment tool 30, the laser contact rod 36' will slide upwardly through the alignment slot 52 and into pivotal receipt by the terminus 92 (best shown in FIG. 6B). The golfer then rotates the alignment tool 30 in a counter clockwise direction (represented by the reference arrow 96 in FIG. 6B) through an arc of 90 degrees, whereby to cause a corresponding rotation of the laser contact rod 36' and the flat face 38 thereof within terminus 92. Because the terminus 92 is wider than the alignment slot 52, the laser contact rod (designated 36" in FIG. 6A) is now captured by the terminus 92 to prevent a withdrawal of contact rod 36" from the alignment slot 52 and a separation of the alignment tool 30 from the laser 22. The alignment tool 30 is therefore pivotally suspended and hangs downwardly from the rotatable turret 70 of laser 22 with the laser contact rod 36" captured by and retained within the terminus 92 (best shown in FIG. 6C).

Figure 6D:
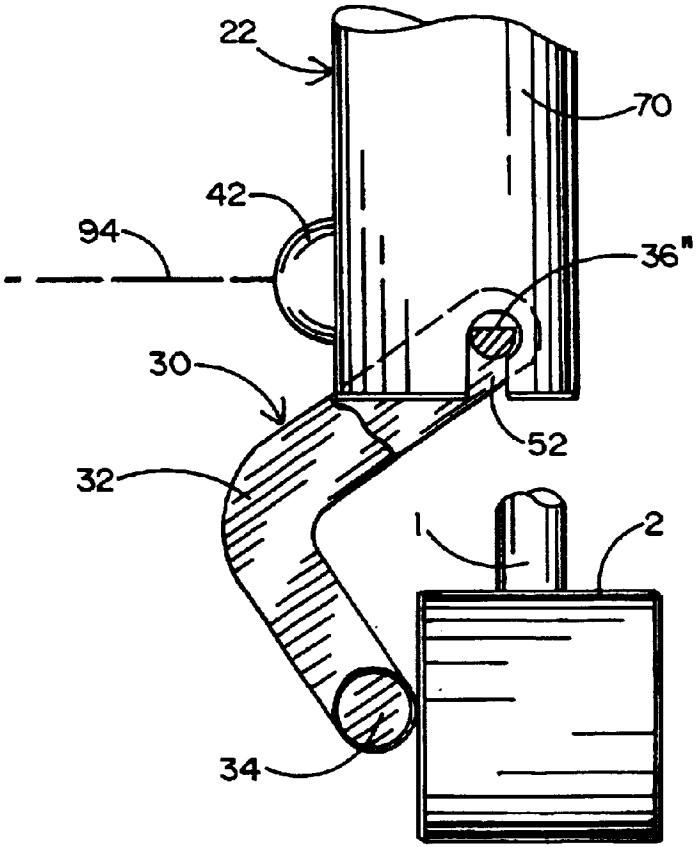
Figure 6C:
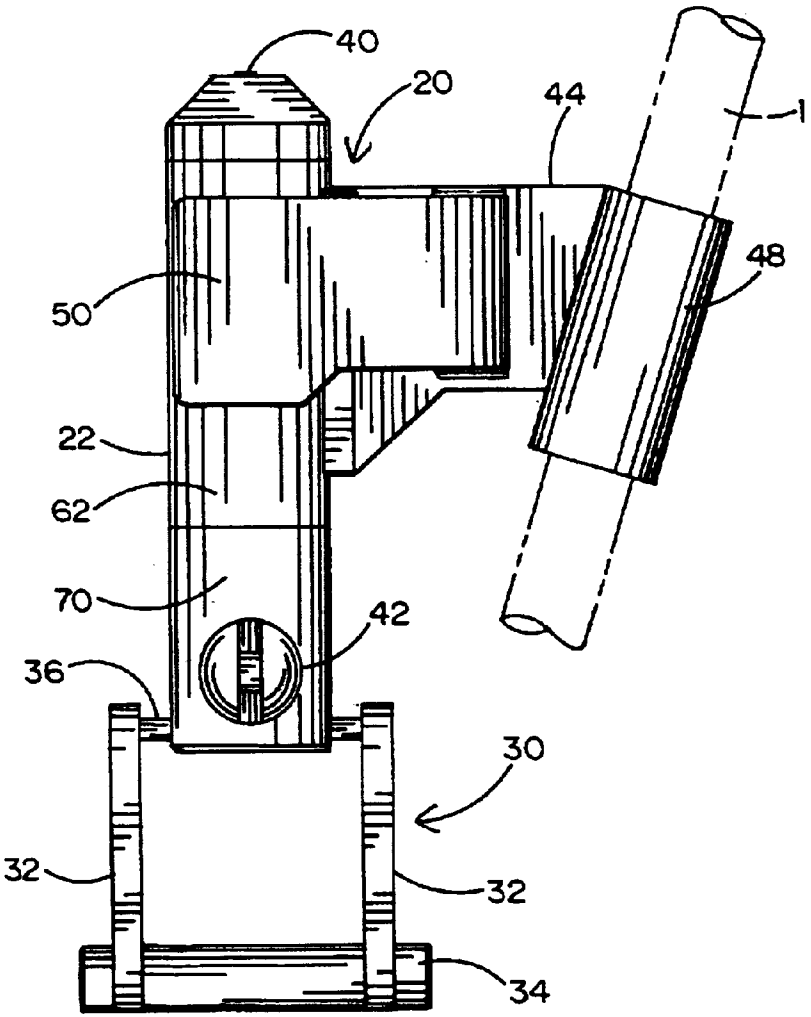

Turning to FIG. 6D, with the alignment tool 30 pivotally suspended (i.e., hanging loosely) from the laser 22, with the toggle lever 50 of clamp 44 in the opened position of FIG. 5A, and the opposing clamping jaws 54 and 56 of the clamp 44 (also of FIG. 5A) surrounding but not yet locked in clamping engagement with the shaft of the putter 1, the laser 22 is now aligned with the putting face of putter head 2 so that the light pattern (designated 24 in FIG. 3) being emitted from the rotatable lens housing 42 will fan out in a vertical plane that is perpendicular to both the horizontal plane of the putting surface (designated 3 in FIG. 3) and the striking face of putter head 2. More particularly, the golfer grasps the laser 22 and applies a rotational force thereto, whereby the clamp 44 and the laser 22 connected to the clamp rotate in unison around the shaft of putter 1. The alignment tool 30 suspended from laser 22 also rotates with clamp 44 around the shaft of putter 1. The rotation of the laser 22 and the alignment tool 30 coupled thereto continue until the face contact rod 34 of alignment tool 30 is moved flush against the putting face of putting head 2.

As described above while referring to FIG. 2, the pair of connecting arms 32 of alignment tool 30 are bent at an angle of 90 degrees. Accordingly, with the laser contact rod 36" at one end of alignment tool 30 pivotally coupled to the laser 22 at the terminus 92 of alignment slot 52 and the face contact rod 34 at the opposite end of alignment tool 30 rotated so as to lie flush against the striking face of putting head 2, the optical axis 94 of the laser 22 (i.e., the longitudinal axis of the rotatable lens housing 42 within which the cylindrical lens 68 of FIG. 4 is housed) will lie perpendicular to the putting face of putting head 2 and parallel to the putting surface 3 of FIG. 3.

The toggle lever 50 of the clamp 44 is then rotated to the closed position of FIG. 5B for causing the opposing clamping jaws 54 and 56 thereof to close, whereby the clamp 44 is now locked in clamping engagement with the shaft of putter 1. The position of the laser 22 connected to the clamp 44 and the optical axis 94 thereof are now fixed relative to the putting head 2 so as to assure that the pattern of light 24 being emitted via the lens housing 42 will fan out in the vertical plane shown in FIG. 1 for casting a horizontal ray of light 24-1 along the putting surface 3 and a vertical ray of light 24-2 on the target post 7.

With the alignment of the laser 22 to the putting head 2 now completed, the alignment tool 30 is moved out of engagement with the turret 70 at the bottom of laser 22. More particularly, the alignment tool 30 and the pivotal laser contact rod 36" at one end thereof are rotated in a clockwise direction back to the position shown in FIG. 6B at which the alignment tool 30 can be uncoupled from the laser 22. That is, the laser contact rod 36" is rotated within terminus 92 (in a direction opposite the direction of reference arrow 96 shown in FIG. 6B) until the flat face 38 is positioned so as to permit the contact rod 36' to slide downwardly through and outwardly from the alignment slot 52, whereupon the alignment tool 30 will be separated from the laser 22. The laser guided putting aid 20 is now firmly attached to putter 1 and aligned with the putting face of putting head 2 so as to be ready to help the golfer practice and perfect his putting stroke.

To this end, and returning to FIG. 1, the golfer can practice his back and forth putting strokes relative to the golf ball while trying to keep the vertical ray of light 24-2 projected on the target post 7 or any other suitable target plane. Should the golfer fail to move the head 2 of his putter 1 along a straight line that is coincident with the horizontal ray of light 24-1 that is projected along putting surface 3 to the target 5, then the vertical ray of light 24-2 will move off and away from target post 7. In this case, the golfer will be immediately:and visually alerted to the fact that his putting stroke is off-line. The golfer may continue to practice his stroke, all the while attempting to have his putting head 2 follow the line of horizontal ray 24-1 towards target 5 so that the vertical ray 24-2 will remain projected against the target post 7, whereby to indicate a desirable linear stroke prior to striking the golf ball.

Figure 7:
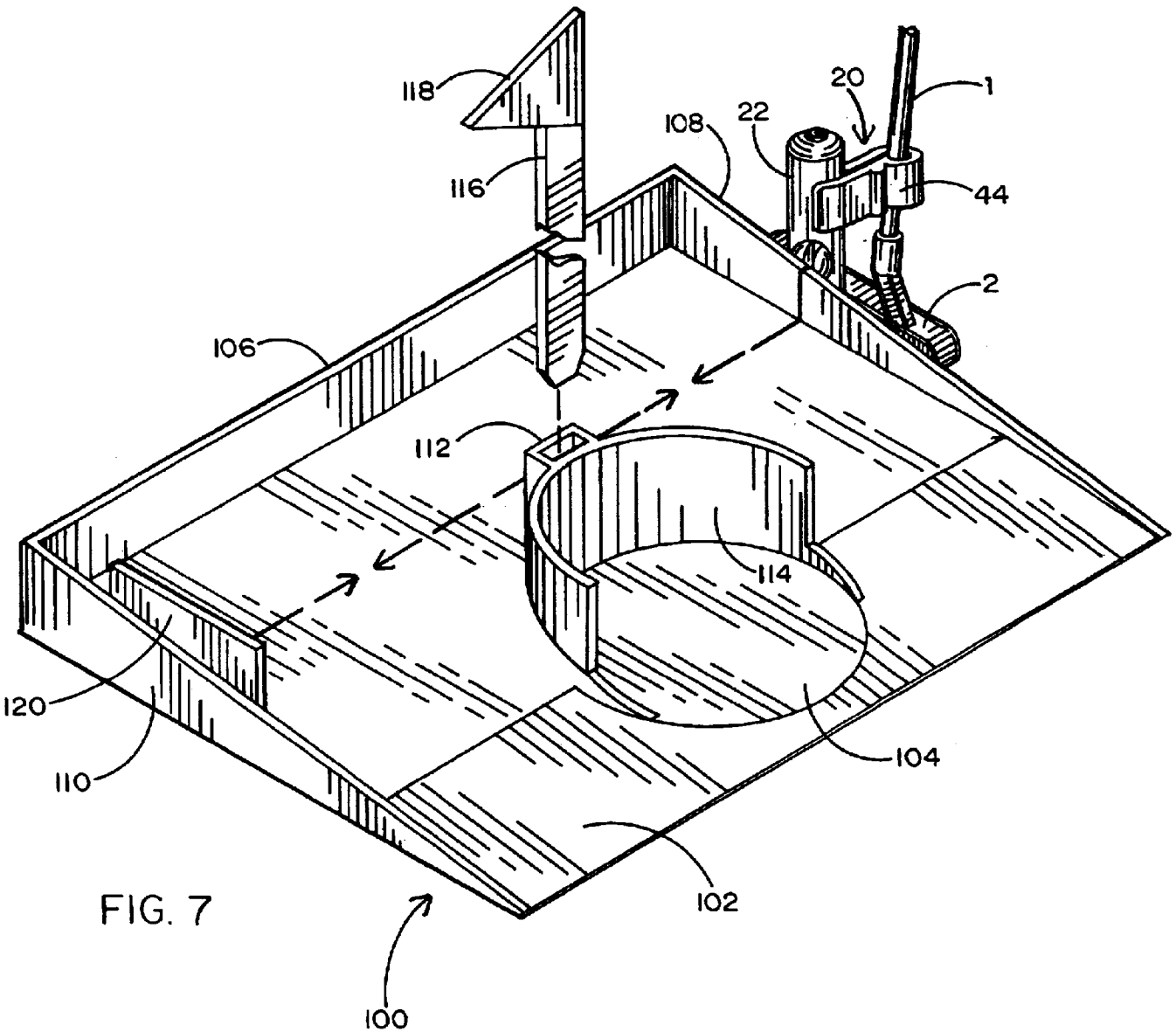
FIG. 7 shows a putting surface according to an alternate embodiment of this invention having a reflective alignment surface mounted thereon for use in aligning the laser guided putting aid to the head of the golfer's putter.

Turning now to FIG. 7 drawings there is shown an alternate embodiment for a putting surface 100. As indicated above, the combination laser guided putting aid 20 and putter 1 can be used by a golfer to practice his putting stroke with the putting surface 3 of FIG. 1, the putting surface 100 of FIG. 7, or with no putting surface at all. In the case of FIG. 7, the putting surface is shortened in length to about 7 to 12 inches. The putting surface 100 may be vacuum formed so as to include an upwardly sloping base 102 that is surrounded by a continuous barrier that rises above the sloping base 102 to block the travel of errant golf balls that are struck towards but out of alignment with a target (e.g. cup) 104 at the center of putting surface 100. The continuous barrier of putting surface 100 includes a back wall 106 located behind the target 104 and a pair of opposite side walls 108 and 110.

A receptacle 112 is mounted behind an arcuate back stop 114 that surrounds the rear of target 104. A target post 116 having an ornamental flag 118 at one end thereof is removably attached to the receptacle 112 behind back stop 114. The target post 116 performs the same function as is also performed by the target post 7 of the putting surface 3 of FIG. 1. Therefore, the target post 116 must be wide enough so that a vertical ray of light (not shown) can be projected therealong by the laser 22 of the laser guided putting aid 20 to provide a reference line for providing visual assistance to a golfer practicing his putting strokes in the manner described above.

The putting surface 100 of FIG. 7 has a self-contained alignment device that can be used in substitution of the alignment tool 30 of FIG. 2. More particularly, the alignment device in this embodiment is a reflective surface (e.g. a mirror) 120 that is mounted upon one of the side walls 110 that forms the barrier around the putting surface 100. The side wall 110 to which the reflective surface 120 is mounted may be longer than the opposing side wall 108.

To complete the alignment process so that the laser 22 and the putting head 2 of the golfer's putter 1 are properly aligned, the striking face of the putting head 2 is placed flush against the side wall 108 of putting surface 100 which lies opposite the side wall 110 to which the reflective surface 120 is affixed. The laser 22 of laser guided putting aid 20 will emit a pattern of light in a vertical plane that produces a horizontal projection across the base 102. The horizontal ray projected across the base 102 of putting surface 100 is reflected by the reflective surface 120 at side wall 110 back towards the laser 22. The combination clamp 44 and laser 22 are rotated around the shaft of putter 1 until the incident and reflected rays of light emitted by the laser 22 and reflected by reflective surface 120 (represented by the arrows) are coincident (i.e. lie atop) one another. Once the incident and reflected rays of light traveling between the opposite side walls 108 and 110 of putting surface 100 are coincident, the clamp 44 of the laser guided putting aid 20 can be tightened to the shaft of the putter 1. At this point, the laser guided putting aid 20 and the putting surface 100 of FIG. 7 can be used by the golfer in an identical manner to practice and perfect his putting stroke as was earlier described when referring to FIG. 1–6.

I claim:

1. For use with a golfer's putter having a shaft and a putting head affixed to the shaft for striking a golf ball, a laser guided putting aid to be detachably connected to the shaft, said laser guided putting aid having a laser to project a ray of light against a target plane to be used as a visual reference by the golfer, said laser having a lens to cause the list emitted from said laser to fan out in said vertical plane so that said ray of light is projected against the target plane and a rotatable turret within which said lens is located, said turret being rotatable by at least 180 degrees to cause a corresponding rotation of said lens so that said laser guided putting aid is adapted to be connected to the shaft of a right or a left handed putter, and an alignment tool to be positioned between the laser and the putting head so that the light emitted by the laser will lie in a vertical plane that is perpendicular to the striking face of the putting head of the putter so as to project said ray of light against the target plane.

2. The laser guided putting aid recited in claim 1, wherein the laser of said laser guided putting aid also has a lens housing in which said lens is mounted, said lens housing being rotatable to cause a corresponding rotation of said lens to adjust the plane in which the light is emitted by said laser.

3. The laser guided putting aid recited in claim 1, wherein said laser guided putting aid also has a clamp to surround the shaft of the putter by which said laser guided putting aid is detachably connected to the shaft.

4. The laser guided putting aid recited in claim 3, wherein said clamp includes a pair of clamping jaws that are shaped to surround the shaft of the putter, one of said clamping jaws being movable towards the other clamping jaw, whereby to generate a clamping force against the shaft and thereby connect said laser guided putting aid thereto.

5. The laser guided putting aid recited in claim 4, wherein said clamp also includes a toggle lever having a cam surface formed thereon, said toggle lever being rotatable towards said movable clamping jaw, whereby the cam surface of said toggle lever is rotated into contact with said movable clamping jaw to cause said movable clamping jaw to move towards the other clamping jaw to generate said clamping force against the shaft.

6. The laser guided putting aid recited in claim 1, wherein said alignment tool includes a laser contact rod at one end thereof to be pivotally coupled to the laser of said laser guided putting aid, whereby said alignment tool is suspended from and rotatable relative to said laser, said alignment tool also including a striking face contact rod at the opposite end thereof to be moved flush against the striking face of the putting head of the golfer's putter as said alignment tool is rotated at said laser contact rod.

7. The combination laser guided putting aid recited in claim 6, wherein said laser contact rod and said striking face contact rod are interconnected with one another at opposite ends of said alignment tool by means of a pair of alignment arms, each of said pair of alignment arms being bent at 90 degrees between said laser contact rod and said striking face contact rod.

8. The laser guided putting aid recited in claim 6, wherein the laser of said laser guided putting aid has an alignment slot formed therein, the laser contact rod of said alignment tool being pivotally connected to the laser within said alignment slot.

9. The laser guided putting aid recited in claim 8, wherein said alignment slot has a relatively wide terminus formed at one end thereof within which to pivotally receive and capture the laser contact rod of said alignment tool so that said alignment tool is suspended from said laser and rotatable at said laser contact rod.

10. For use with a golfer's putter having a shaft and a putting head affixed to the shaft for striking a golf ball, the combination comprising:

a putting surface having a target towards which the golf ball can be struck and a target plane projecting vertically upward from said target, said putting surface having first and opposite ends;

a laser guided putting aid to be connected to the shaft of the putter and having a laser to emit a pattern of light in a vertical plane along said putting surface such that a vertical ray of light is projected against the target plane above the target to be used as a visual reference by the golfer; and an alignment device by which the laser is aligned with the putting head of the putter so that the vertical plane in which the pattern of light is emitted from the laser is aligned perpendicular to the putting head, said alignment device including a light reflective surface located at the first end of said putting surface to reflect light that is emitted by the laser when the striking face of the putting head of the putter is placed at the opposite end of said putting surface and the laser is aimed at said light reflective surface.

11. The combination recited in claim 10, where said light reflective surface is a mirror.

12. The combination recited in claim 10, wherein said laser guided putting aid also has a clamp to surround the shaft of the putter by which said laser guided putting aid is detachably connected to the shaft, said clamp including a pair of clamping jaws that are shaped to surround the shaft, one of said clamping jaws being movable towards the other clamping jaw, whereby to generate a clamping force against the shaft and thereby connect said laser guided putting aid thereto.

13. The combination recited in claim 12, wherein said clamp also includes a toggle lever having a cam surface formed thereon, said toggle lever being rotatable towards said movable clamping jaw, whereby the cam surface of said toggle lever is rotated into contact with said movable clamping jaw to cause said movable clamping jaw to move towards the other clamping jaw to generate said clamping force against the shaft.

14. The combination recited in claim 10, wherein said alignment device is an alignment tool including a laser contact rod at one end thereof pivotally coupled to the laser of said laser guided putting aid, whereby said alignment tool is suspended from and rotatable relative to said laser, said alignment tool also including a striking face contact rod at the opposite end thereof to be moved flush against the striking face of the putting head of the golfer's putter as said alignment tool is rotated at said laser contact rod.

15. The combination recited in claim 14, wherein said laser contact rod and said striking face contact rod are interconnected with one another at opposite ends of said alignment tool by means of a pair of alignment arms, each of said pair of alignment arms being bent at 90 degrees between said laser contact rod and said striking face contact rod.

16. For use with a golfer's putter having a shaft and a putting head affixed to the shaft for striking a golf ball, a laser guided putting aid to be detachably connected to the shaft, said laser guided putting aid having a laser to project a ray of light against a target plane to be used as a visual reference by the golfer, and an alignment tool to cause the light emitted by the laser to lie in a plane that is perpendicular to the striking face of the putting head of the putter, said alignment tool including a laser contact rod pivotally coupled to the laser whereby said alignment tool is suspended from and rotatable relative to said laser, said alignment tool also including a striking face contact surface to be moved against the striking face of the putting head as the alignment tool is rotated at said laser contact rod thereof.

17. The laser guided putting aid recited in claim 16, wherein said striking face contact surface is a striking face contact rod carried by and rotated with said alignment tool to be moved flush against the striking face of the putting head of the putter as the alignment tool is rotated at said laser contact rod thereof.

18. The combination recited in claim 17, wherein said laser contact rod and said striking face contact rod are interconnected with one another at opposite ends of said alignment tool by means of a pair of alignment arms, each of said pair of alignment arms being bent at 90 degrees between said laser contact rod and said striking face contact rod.

19. The combination recited in claim 16, wherein the laser of said laser guided putting aid has an alignment slot formed therein, the laser contact rod of said alignment tool being pivotally connected to the laser within said alignment slot.

20. For use with a golfer's putter having a shaft and a putting head affixed to the shaft for striking a golf ball, a laser guided putting aid to be detachably connected to the shaft, said laser guided putting aid having a laser to project a ray of light against a target plane to be used as a visual reference by the golfer and an alignment tool detachably connected to said laser and rotatable relative thereto in order to be moved into contact with the striking face of the putting head so that the light emitted by the laser will lie in a vertical plane that is perpendicular to the striking face of the putting head so as to project said ray of light against the target plane.

* * * * *